US006977613B2

(12) United States Patent
He et al.

(10) Patent No.: US 6,977,613 B2
(45) Date of Patent: Dec. 20, 2005

(54) HIGH PERFORMANCE DUAL-PATCH ANTENNA WITH FAST IMPEDANCE MATCHING HOLES

(75) Inventors: Ziming He, Irvine, CA (US); Ping Peng, Irvine, CA (US); Jim X. Zhao, Cypress, CA (US); Chiu-Yu Tang, Lake Forest, CA (US); Tien-Lu Kao, La Mirade, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 150 days.

(21) Appl. No.: 10/749,197

(22) Filed: Dec. 30, 2003

(65) Prior Publication Data

US 2005/0146467 A1 Jul. 7, 2005

(51) Int. Cl.[7] ..... H01Q 1/38

(52) U.S. Cl. ..... 343/700 MS; 343/830; 343/846

(58) Field of Search ..... 343/700 MS, 830, 343/846, 824, 829, 850, 853, 860, 878, 879

(56) References Cited

U.S. PATENT DOCUMENTS

| | | | | |
|---|---|---|---|---|
| 4,151,531 | A | 4/1979 | Kaloi | 343/700 MS |
| 5,410,749 | A * | 4/1995 | Siwiak et al. | 455/280 |
| 5,734,350 | A | 3/1998 | Deming et al. | 343/700 MS |
| 6,246,368 | B1 | 6/2001 | Deming et al. | 343/700 MS |
| 6,512,489 | B2 * | 1/2003 | Boyle | 343/850 |
| 6,624,786 | B2 * | 9/2003 | Boyle | 343/700 MS |
| 6,861,988 | B2 * | 3/2005 | Gabriel et al. | 343/700 MS |
| 6,903,687 | B1 * | 6/2005 | Fink et al. | 343/700 MS |

* cited by examiner

*Primary Examiner*—Thuy Vinh Tran
(74) *Attorney, Agent, or Firm*—Wei Te Chung

(57) ABSTRACT

A high gain and omni-directive dual-patch antenna (1) for wireless communication under IEEE 802.11b/g standard includes a top and a bottom radiating patches (10) and (20) which have the same dimension, each of which in effect being a ground portion of the other, an air parch dielectric substrate between the two radiating patches, a feeding cable (30) inserted between the two radiating patches, and a support potion (40). A plurality of matching holes (202) is defined in both radiating patches and is provided for fast impedance match tuning and heat dissipation.

20 Claims, 7 Drawing Sheets

| | Peak Gain(dBi) | | | |
|---|---|---|---|---|
| Frequency (MHz) | 2400 | 2465 | 2500 | 2600 |
| H Polarization | 7.52 | 7.29 | 6.93 | 4.73 |
| V Polarization | -2.01 | -1.83 | -3.05 | -5.81 |

FIG. 5

HIGH PERFORMANCE DUAL-PATCH ANTENNA WITH FAST IMPEDANCE MATCHING HOLES

BACKGROUND OF THE INVENTION

1. Field of the Invention

The present invention relates generally to an antenna, and more particularly to a dual-patch antenna.

2. Description of the Prior Art

In recent years, Wireless Local Area Network(WLAN) products under IEEE 802.11b/g standard, such as WLAN cards for computers are gaining popularity in wireless communication market. These cards benefit from high gain antennas. In many cases, patch antennas are used.

As well known, a patch antenna usually utilizes a planar conductive patch disposed parallel to a big ground portion and separated from the ground portion by a thin dielectric layer. A feed point is provided to communicate electromagnetic energy to or from the patch. Antennas of this nature may be inexpensively manufactured and may be readily formed into low cost, light weighted phased antenna systems. A typical traditional patch antenna of this case is disclosed in U.S. Pat. No. 5,734,350. Though the traditional patch antenna has much advantage mentioned above, a drawback is that it has a big ground portion resulting in a large size of the antenna. Another drawback is that the radiating pattern of the traditional patch antenna is not omni-direction, thus the scope of the use of the traditional antennas is limited.

As to other type prior arts different from the above one, a family of dual-patch antennas is disclosed in U.S. Pat. No. 4,151,531. The typical antenna of the prior art comprises a dielectric substrate and two electrically conducting rectangular shape elements formed on both sides of the dielectric substrate. The element on one side of the substrate is the mirror image of the element on the other side of the substrate. Each of the elements acts, in effect as a ground portion for the other. The antenna has much smaller size because the antenna does not have a very big absolute ground portion. Additionally, the antenna has good radiating pattern of omni-direction. However, there are some difficulties with the dual-patch antenna. First, the input impedance of the antenna is tuned by varying the location of the feed point, which cannot obtain excellent efficiency. Second, the bandwidth of the antenna is narrow. Usually, to increase the bandwidth of a patch antenna, the thickness of the dielectric substrate is increased, which easily results in impedance mismatching between the antenna and its feeding cable. For an antenna design, impedance matching is one of the most important factors. The impedance mismatching causes a portion of the feed power to be reflected to the signal source rather than to be radiated to the free space. The greater this reflected feed power, the less power that is radiated from the antenna, thus reducing the gain of the patch antenna. So the gain of the patch antenna is sacrificed to achieve wider bandwidth in such resolution. Third, the dielectric substrate of the traditional patch antenna will introduce insertion loss, which does not fit a high gain application.

Hence, in this art, a dual-patch air parch antenna with high performance, simple structure and low cost to overcome the above-mentioned disadvantages of the prior art will be described in detail in the following embodiments.

BRIEF SUMMARY OF THE INVENTION

A primary object, therefore, of the present invention is to provide an omni-directional dual-patch antenna with high gain, wide bandwidth, excellent impedance matching and compact size, for operating in wireless communications under IEEE 802.11b/g standard.

In order to implement the above object and overcomes the above-identified deficiencies in the prior art, the dual-patch antenna of the present invention comprises an air parch dielectric substrate, a top and a bottom radiating patches which are separately disposed on each side of the dielectric substrate, the two radiating patches having the same dimension and being parallel to each other, a feeding cable inserted between the two radiating patches, and a support portion. A plurality of matching holes is defined by both radiating patches and is provided for fast impedance match tuning and heat dissipation. The location of matching holes depends on the antenna length. The number of matching holes depends on the tuning range of the antenna length. The adding of matching holes speeds up the impedance matching procedure and optimizes the efficiency of impedance matching. Both patches (top and bottom) having the same dimension and holes makes the mass manufacturing of the antenna become fast and easy.

Other objects, advantages and novel features of the invention will become more apparent from the following detailed description of a preferred embodiment when taken in conjunction with the accompanying drawings.

BRIEF DESCRIPTION OF THE DRAWINGS

FIG. 5 is a table showing the measured peak gain at four main frequency points of the antenna.

DETAILED DESCRIPTION OF THE INVENTION

Reference will now be made in detail to a preferred embodiment of the present invention.

Figure 1:
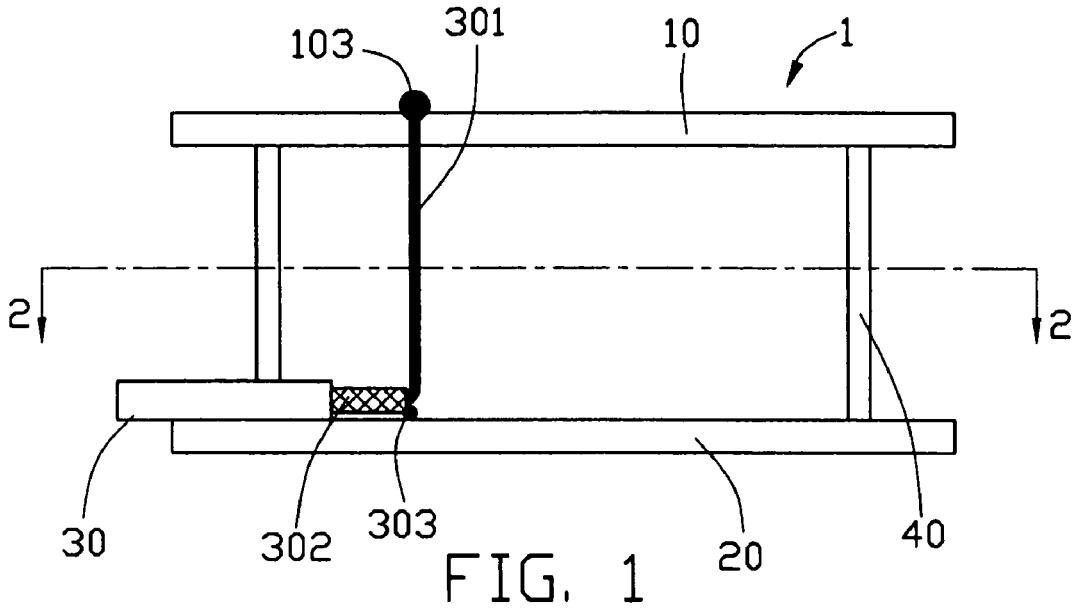
FIG. 1 is a side view of a preferred embodiment of a dual-patch antenna in accordance with the present invention.
Figure 2:
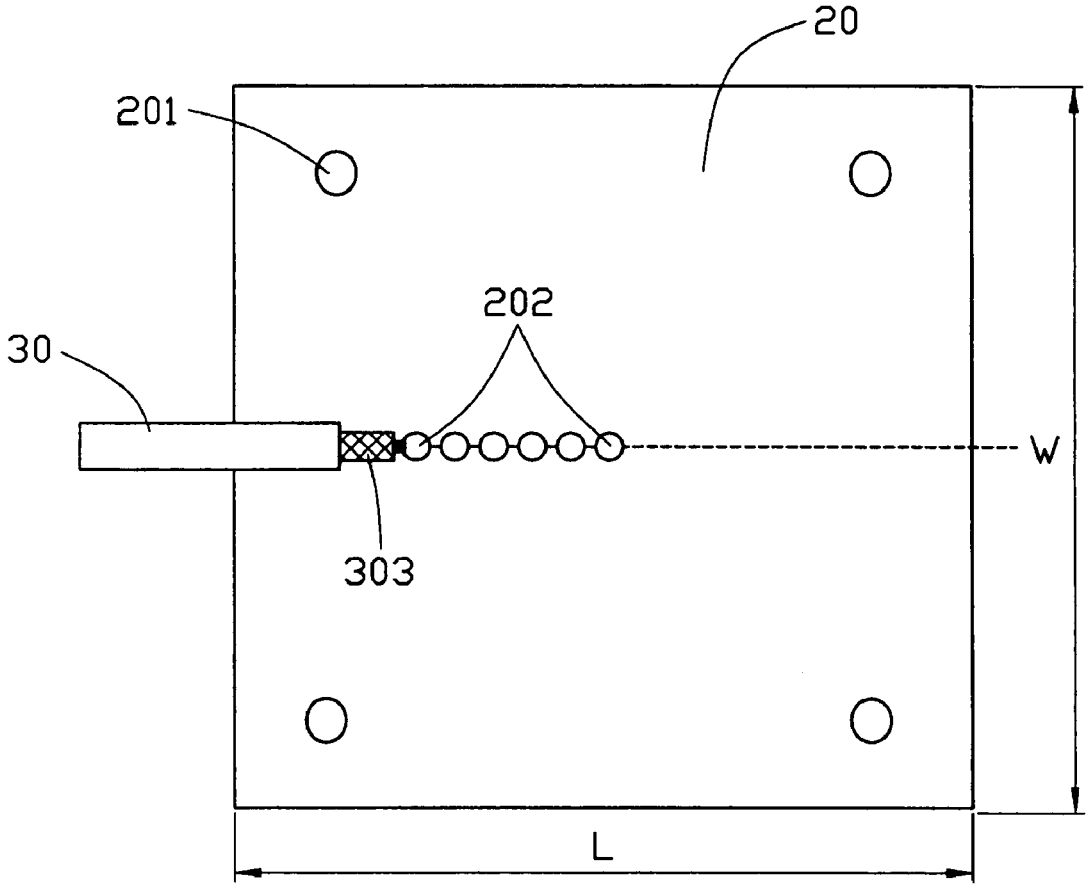
FIG. 2 is a cross-sectional view taken along line 2—2 of FIG. 1.

Referring to FIGS. 1–2, a dual-patch antenna 1 according to the present invention comprises a top radiating patch 10, a bottom radiating patch 20, a feeding cable 30, and a support portion 40.

The top and the bottom radiating patches 10 and 20 are made of conducting material, for example copper. The two radiating patches 10 and 20 are both rectangular and are of the same dimension. The top radiating patch 10 is parallel to the bottom radiating patch 20. Each of the patches 10 and 20 acts, in effect as a ground portion for the other. Air is filled between the radiating patches 10 and 20.

Each radiating patch defines a plurality of matching holes 202. The matching holes 202 are distributed on the left-half plane of the radiating patches and are located in a center line of the antenna width W. The matching holes 202 are of the same dimension. The diameter of each matching hole 202 must be much smaller than that of the minimum operation wavelength (at least less than 1/10 of minimum wavelength). The location of the matching holes 202 depends on the antenna length L. The number of the matching holes 202 depends on the tuning range of the antenna length L. The matching holes 202 are provided mainly for impedance match tuning and also for heat dissipation.

The two radiating patches 10 and 20 are supported by a support portion 40. In this preferred embodiment, the support portion 40 is a plurality of plastic rods (not labeled). The rods are situated between and are perpendicular to the two radiating patches 10 and 20. A plurality of fixing holes 201 are defined in the radiating patches 10 and 20 for fixing the support rods.

The feeding cable 30 is a coaxial cable and comprises an inner conductor 301 and an outer conductor 302. The feeding cable 30 is inserted between the two radiating patches 10 and 20 and is located on an upper surface and in the center line of the width of the bottom radiating patch 20. The inner conductor 301 extends upwardly through a second matching hole 202 from left-hand into the top radiating patch 10 and is electrically connected to the top radiating patch 10. The top joint 103 between the inner conductor 301 and the top radiating patch 10 is in a center line of the width of the top radiating patch 10. The outer conductor 302 is electrically connected to the bottom radiating patch 20. The bottom joint 303 between the outer conductor 302 and the bottom radiating patch 20 is the projection of the top joint 103.

Figure 3:
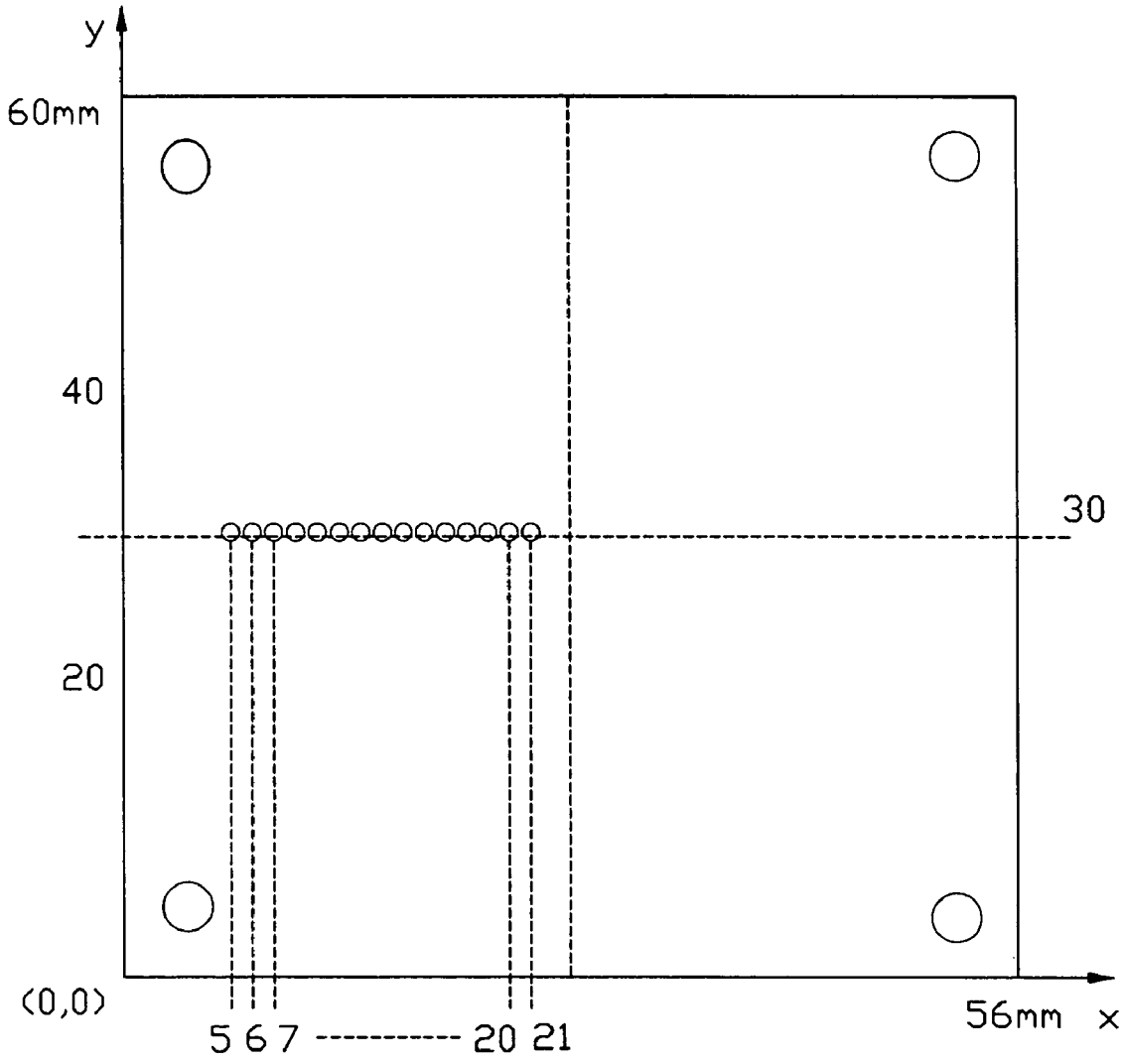
FIG. 3 is a top view of the dual-patch antenna of FIG. 1, showing the detail dimensions of the radiating patches of the antenna.

Referring to FIG. 3, the concrete dimension of each radiating patch of the antenna 1 is shown. The x-axis is corresponding to the direction of the antenna length L. The y-axis is corresponding to the direction of the antenna width W. In this preferred embodiment, there are totally seventeen matching holes settled in a line and provided for best impedance matching, hence an improvement in bandwidth results.

Figure 4:
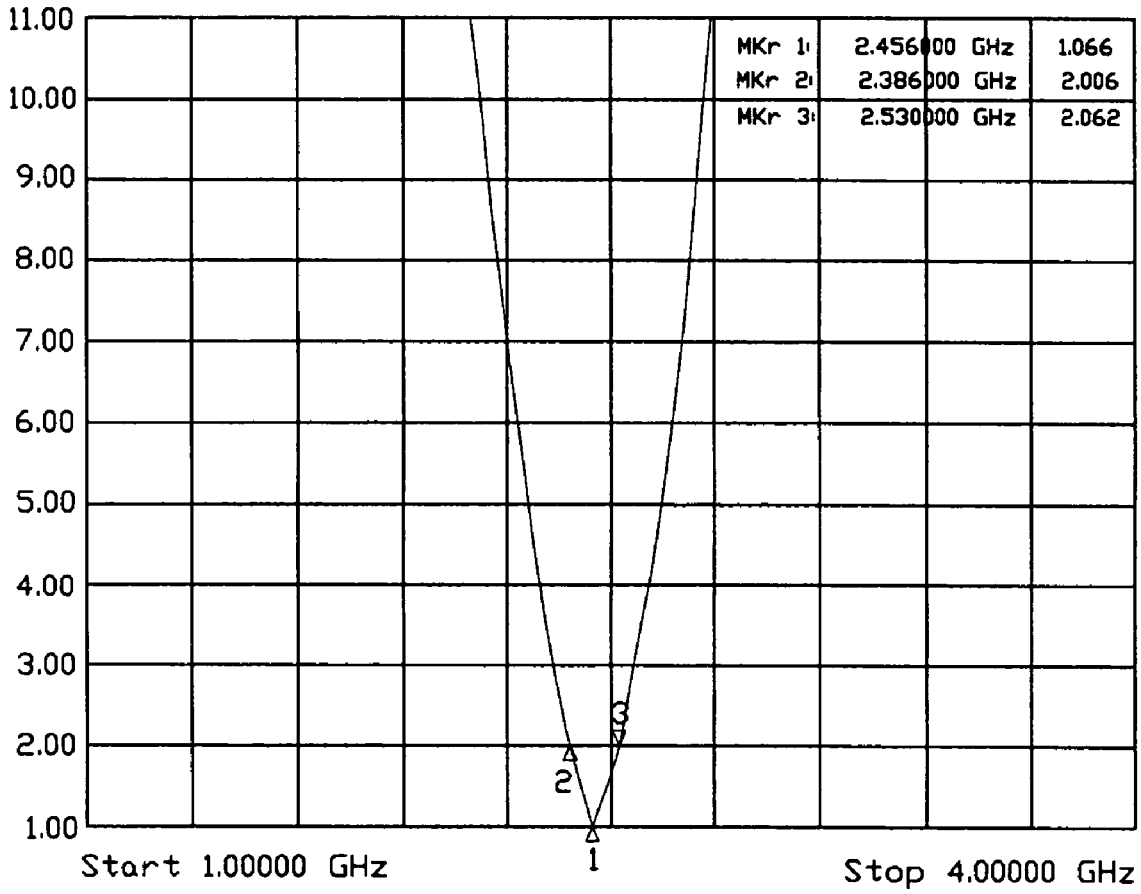
FIG. 4 is a test chart recording of Voltage Standing Wave Ratio (VSWR) of the dual-patch antenna as a function of frequency.
Figure 6:
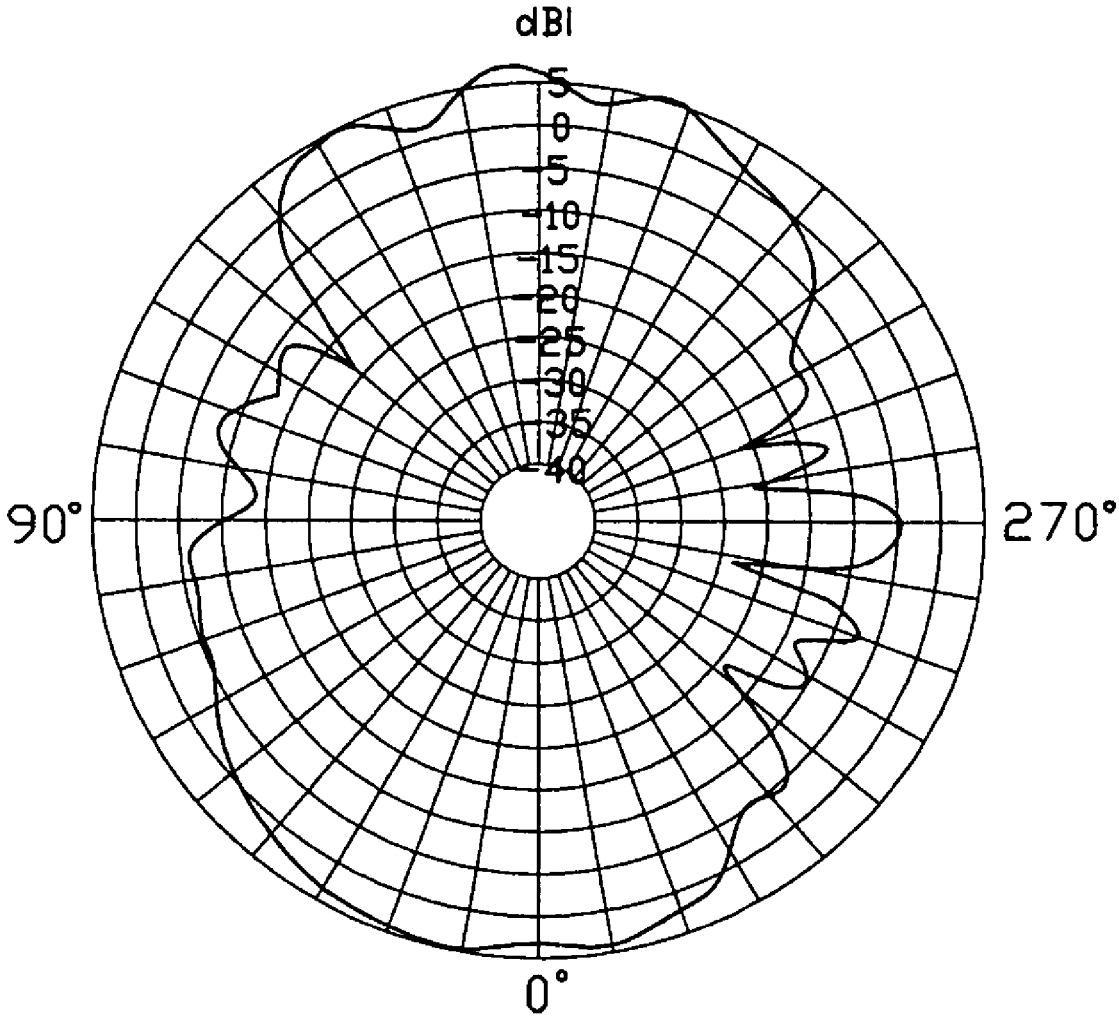
FIG. 6 is a horizontally polarized principle plane radiation pattern of the antenna operating at the resonant frequency of 2.465 GHz.
Figure 7:
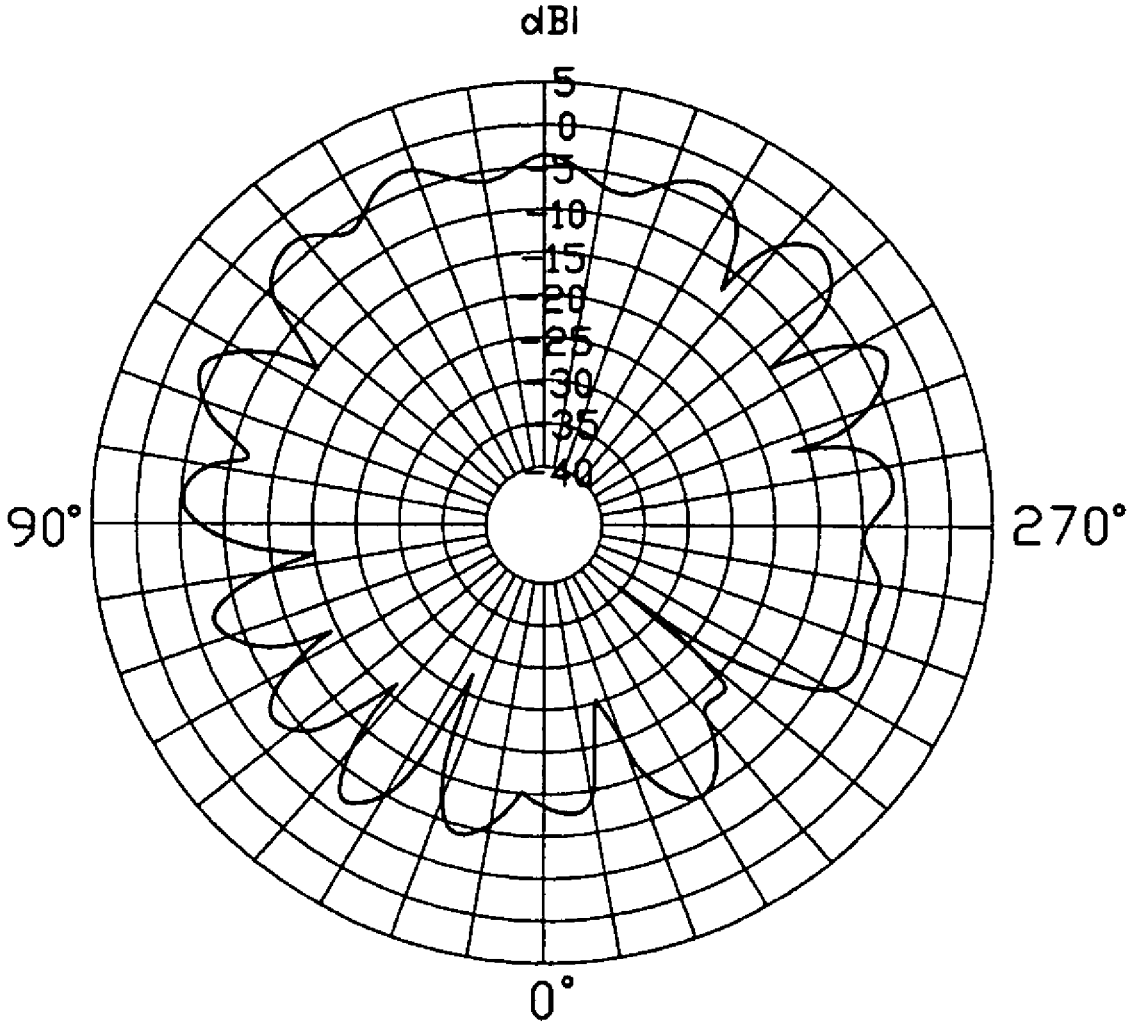
FIG. 7 is a vertically polarized principle plane radiation pattern of the antenna operating at the resonant frequency of 2.465 GHz.

In terms of this preferred embodiment, the performance of the antenna 1 is excellent. The ADS simulation result shows that the peak gain of the antenna 1 is +6.8 dBi with excellent radiation pattern, and the bandwidth is larger than 100 MHz. The measured results match the simulation very well. In order to illustrate the effectiveness of the present invention, FIG. 4 sets forth a test chart recording of Voltage Standing Wave Ratio (VSWR) of the dual-patch antenna 1 as a function of frequency. Note that VSWR drops below the desirable maximum value "2" in the 2.386 G–2.530 GHz frequency band, indicating a wide frequency bandwidth of 144 MHz, which covers the bandwidth of wireless communications under IEEE 802.11b/g standard. FIG. 5 sets forth a table showing the measured peak gain at the frequencies of 2.4 G, 2.465 G, 2.5 G and 2.6 GHz. The peak gain in dominant plane shows a high gain of +6.93 dBi to +7.52 dBi in the frequency range of 2400 to 2500 MHz. FIGS. 6–7 show the horizontally polarized and vertically polarized principle plane radiation patterns of the antenna 1 operating at the resonant frequency of 2.465 GHz. Note that the each radiation pattern of the antenna 1 is close to corresponding optimal radiation pattern and there is no obvious radiating blind area, conforming to the practical use conditions of an antenna.

The adding of matching holes 202 speeds up the impedance matching procedure and optimizes the efficiency of impedance matching. Both the top and the bottom radiating patches 10 and 20 having the same dimension and matching holes makes the mass manufacturing of the dual-patch antenna 1 become fast and easy.

Figure 8:
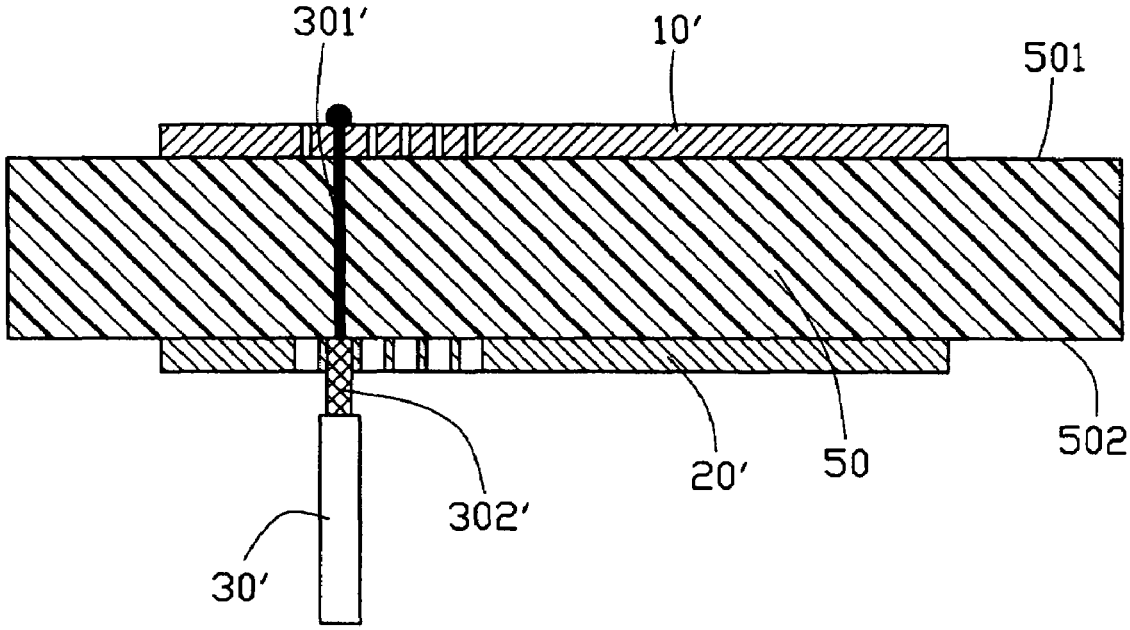
FIG. 8 is a side view of a second embodiment of the dual-patch antenna according to the present invention.

Referring to FIG. 8, an antenna (not labeled) according to a second embodiment comprises a dielectric substrate 50 having a top side 501 and a bottom side 502. Two radiating patches 10' and 20' are respectively disposed on the top and bottom sides 501 and 502 of the dielectric substrate 50. The radiating patches 10' and 20' are the same as what is described in the above-mentioned preferred embodiment. A feeding cable 30' is perpendicular to the radiating patches 10' and 20' with an inner conductor 301' and an outer conductor 302' respectively electrically connected with the radiating patches 10' and 20'. The concrete connection can refer to the preferred embodiment.

In other embodiments, the two radiating patches can be of different dimensions and can be some other shapes besides rectangular. The number of the matching holes 202 can be changed according to the antenna length L and tuning range.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A patch antenna, comprising:

a dielectric substrate having a top side and a bottom side;

two conducting patches respectively disposed on the top and the bottom sides of the dielectric substrate, at least one of the two conducting patches defining a plurality of matching holes for impedance match tuning; and a feeding cable comprising an inner conductor and an outer conductor, the inner conductor electrically connected to one conducting patch and the outer conductor electrically connected to another conducting patch.

2. The patch antenna as claimed in claim 1, wherein the matching holes are distributed in a straight line.

3. The patch antenna as claimed in claim 2, wherein the conducting patches have symmetrical geometry shapes and the matching holes are located in a center line of the conducting patches.

4. The patch antenna as claimed in claim 1, wherein the conducting patches comprise a top radiating patch and a bottom radiating patch.

5. The patch antenna as claimed in claim 1, wherein the dielectric substrate is air.

6. The patch antenna as claimed in claim 1, wherein the matching holes have the same dimension.

7. The patch antenna as claimed in claim 1, wherein the antenna has a support portion situated between and perpendicular to the conducting patches for supporting the conducting patches.

8. The patch antenna as claimed in claim 4, wherein the top and the bottom radiating patches are in effect the grounding planes of each other.

9. A dual-patch antenna, comprising:

a top radiating patch;

a bottom radiating patch being separately parallel to the top radiating patch and having the same dimension as the top radiating patch;

a feeding cable inserted between the top and the bottom radiating patches and comprising an inner conductor and an outer conductor, the inner conductor and the outer conductor separately electrically connected to the top and the bottom radiating patches; and a support portion situated between and perpendicular to the two radiating patches for supporting the radiating patches.

10. The dual-patch antenna as claimed in claim 9, wherein at least one of the two radiating patches defines a plurality of matching holes for impedance match tuning.

11. The dual-patch antenna as claimed in claim 9, wherein the radiating patches are both rectangular.

12. The dual-patch antenna as claimed in claim 10, wherein the matching holes distribute in a center line on the radiating patches.

13. The dual-patch antenna as claimed in claim 9, wherein the outer conductor of the feeding cable is located on the surface and in the center line of the bottom radiating patch.

14. The dual-patch antenna as claimed in claim 9, wherein the support portion comprises a plastic rod.

15. A patch antenna comprising:

a first conducting patch;

a second conducting patch spatially parallel to and aligned with the first conducting patch; and a feeding cable including an inner conductor electrically connected to the first conducting patch around a first portion of the first conducting patch, and an outer conductor electrically connected to the second conducting patch around a second portion of the second conducting patch; wherein a plurality of matching holes are formed around at least one of said first and second portions.

16. The patch antenna as claimed in claim 15, wherein said plurality of matching holes are arranged along a line of one of said first and second conducting patch.

17. The patch antenna as claimed in claim 15, wherein a space between said first and second conducting patches is filled with air.

18. The patch antenna as claimed in claim 15, wherein a space between said first and second conducting patches is filled with an insulative substrate.

19. The patch antenna as claimed in claim 17, wherein said mating holes additionally functions as heat dissipation means.

20. The patch antenna as claimed in claim 15, wherein both said first and second patches are equipped with said matching holes.

* * * * *